US007297886B2

(12) United States Patent
Noguchi et al.

(10) Patent No.: US 7,297,886 B2
(45) Date of Patent: Nov. 20, 2007

(54) DUSTPROOF STRUCTURE FOR AN ELECTRONIC EQUIPMENT

(75) Inventors: Yoshihiro Noguchi, Chiba (JP); Masahiro Arai, Chiba (JP)

(73) Assignee: Futaba Corporation, Chiba (JP)

( * ) Notice: Subject to any disclaimer, the term of this patent is extended or adjusted under 35 U.S.C. 154(b) by 0 days.

(21) Appl. No.: 11/298,521

(22) Filed: Dec. 12, 2005

(65) Prior Publication Data

US 2006/0131148 A1 Jun. 22, 2006

(30) Foreign Application Priority Data

Dec. 10, 2004 (JP) ..... 2004-359244

(51) Int. Cl.
*H01H 1/64* (2006.01)

(52) U.S. Cl. ..... 200/293; 200/296; 200/302.1

(58) Field of Classification Search ..... 200/293, 200/296, 302.1, 333, 43.18, 43.22
See application file for complete search history.

(56) References Cited

U.S. PATENT DOCUMENTS

| | | | | |
|---|---|---|---|---|
| 1,727,767 | A * | 9/1929 | Hammerly | 200/50.12 |
| 2,354,224 | A * | 7/1944 | Stein | 200/304 |
| 4,688,023 | A * | 8/1987 | McGill et al. | 340/545.6 |
| 5,543,593 | A * | 8/1996 | Turek | 200/43.11 |
| 5,803,237 | A * | 9/1998 | Gandre et al. | 200/43.01 |
| 5,949,039 | A * | 9/1999 | Koek et al. | 200/50.1 |
| 6,316,740 | B1 * | 11/2001 | Merkin et al. | 200/502 |
| 6,495,775 | B2 * | 12/2002 | Lawson et al. | 200/50.28 |

* cited by examiner

*Primary Examiner*—K. Richard Lee
(74) *Attorney, Agent, or Firm*—Bacon & Thomas, PLLC

(57) ABSTRACT

A dustproof structure for an electronic equipment includes internal switches disposed in a housing forming an external frame of the electronic equipment and an opening for use in operating the internal switches. The dustproof structure further includes a shutter plate for opening or closing the opening; and a cover plate for supporting the shutter plate, the shutter plate being freely slidable between the cover plate and the housing. A slide recess serving as a sliding area of the shutter plate is formed in the housing or the cover plate.

4 Claims, 5 Drawing Sheets

DUSTPROOF STRUCTURE FOR AN ELECTRONIC EQUIPMENT

FIELD OF THE INVENTION

The present invention relates to a dustproof structure for preventing dust or the like from entering a housing of an electronic equipment.

BACKGROUND OF THE INVENTION

Some electronic equipments have internal switches installed inside the equipments. Thus, a housing of such an electronic equipment is provided with an opening for use in manipulating the internal switches from the outside of the housing. Further, such an electronic equipment is conventionally equipped with a dustproof structure for preventing dust particles or the like from entering the housing thereof, and the opening is configured such that it can be opened only when operating the internal switches.

Japanese Utility Model Laid-open Publication No. H5-78295 discloses an example of such a dustproof structure for use in a conventional electronic equipment, e.g., a receiver of a radio controller.

FIGS. 6 to 8 illustrate the receiver of the radio controller disclosed in Japanese Utility Model Laid-open Publication No. H5-78295 (hereinafter, simply referred to as a radio control receiver). Specifically, FIG. 6 is a plan view of the radio control receiver; FIG. 7 is a side view thereof; and FIG. 8 sets forth a plan view of the receiver from which a cover is opened.

As shown in the figures, the radio control receiver 10 includes an approximately box-shaped housing 20. Provided in a lateral surface of the housing 20 are terminals 30 connected to a servo mechanism for driving a power supply battery or a driving unit of an object to be controlled. Also, a linear antenna 40 is drawn out to be extended from the inside of the housing 20 through a lateral surface thereof.

Moreover, a circuit board (not shown) forming a receiver circuit is disposed in the housing 20, and a pair of rotary type dual inline package switches (hereinafter referred to as "DIP switches") 50 for switching a receive frequency of the radio control receiver 10 are mounted on the circuit board as internal switches. Further, an opening 20*a* is provided at the housing 20 at a position corresponding to the DIP switches 50 to expose the DIP switches 50 to the outside.

A translucent cover 60 formed of, e.g., a resin material is installed in the housing 20 to be freely slidable over the opening 20*a*. The cover 60 is of a substantially rectangular shape of a size large enough to cover the opening 20*a* completely. A cross section of the cover 60 along a direction parallel to a shorter side thereof is of a substantially trapezoid shape, and the cover 60 is installed in the housing 20 to be protruded therefrom. Further, guide grooves 60*a* are formed at both shorter lateral surfaces of the cover 60.

In addition, protruded portions 20*b* are formed in the housing 20 along both shorter sides of the opening 20*a*. By locking the guide grooves 60*a* of the cover 60 with the protruded portions 20*b*, the cover 60 can be configured to be slidable with respect to the housing 20.

In this configuration, when operating the DIP switches 50, the cover 60 is slid off the openings 20*a* to thereby expose the DIP switches 50 for a user to operate them. When the DIP switches 50 need not be operated, the cover 60 is closed to prevent intrusion of dust or the like from outside.

As for such a conventional dustproof structure for the electronic equipment, however, since the cover is installed in the housing of the electronic equipment such that it is protruded to be entirely exposed to the outside, a user's finger or an object can happen to make an unintended contact with the cover to exert an excessive force. At this time, if an excessive load is exerted on the cover such that the cover can be separated from the housing or be damaged.

Moreover, with the recent technological advances, various electronic components included in an electronic equipment are greatly reduced in their sizes and thus the size of the electronic equipment itself is getting smaller as well, while providing same functions.

However, in the conventional dustproof structure for use in the electronic equipment, since the entire cover is attached on the housing as mentioned above, the cover portion may protrude higher than the other surface portion on the same plane. Therefore, the presence of the cover would be an obstacle to the size reduction of the electronic equipment.

SUMMARY OF THE INVENTION

It is, therefore, an object of the present invention to provide a dustproof structure for an electronic equipment, whose cover plate will not be separated from the equipment or damaged even if it is unintentionally touched or pressed by a user or an object.

In accordance with the present invention, there is provided a dustproof structure for an electronic equipment which includes internal switches disposed in a housing forming an external frame of the electronic equipment and an opening for use in operating the internal switches, the dustproof structure include: a shutter plate for opening or closing the opening; and a cover plate for supporting the shutter plate, the shutter plate being freely slidable between the cover plate and the housing, wherein a slide recess serving as a sliding area of the shutter plate is formed in the housing or the cover plate.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Below, a dustproof structure in accordance with a preferred embodiment of the present invention will be described with reference to the accompanying drawings. The dust prevention mechanism is applied to, for example, a receiver of a radio controller. The description will be provided.

Figure 1:
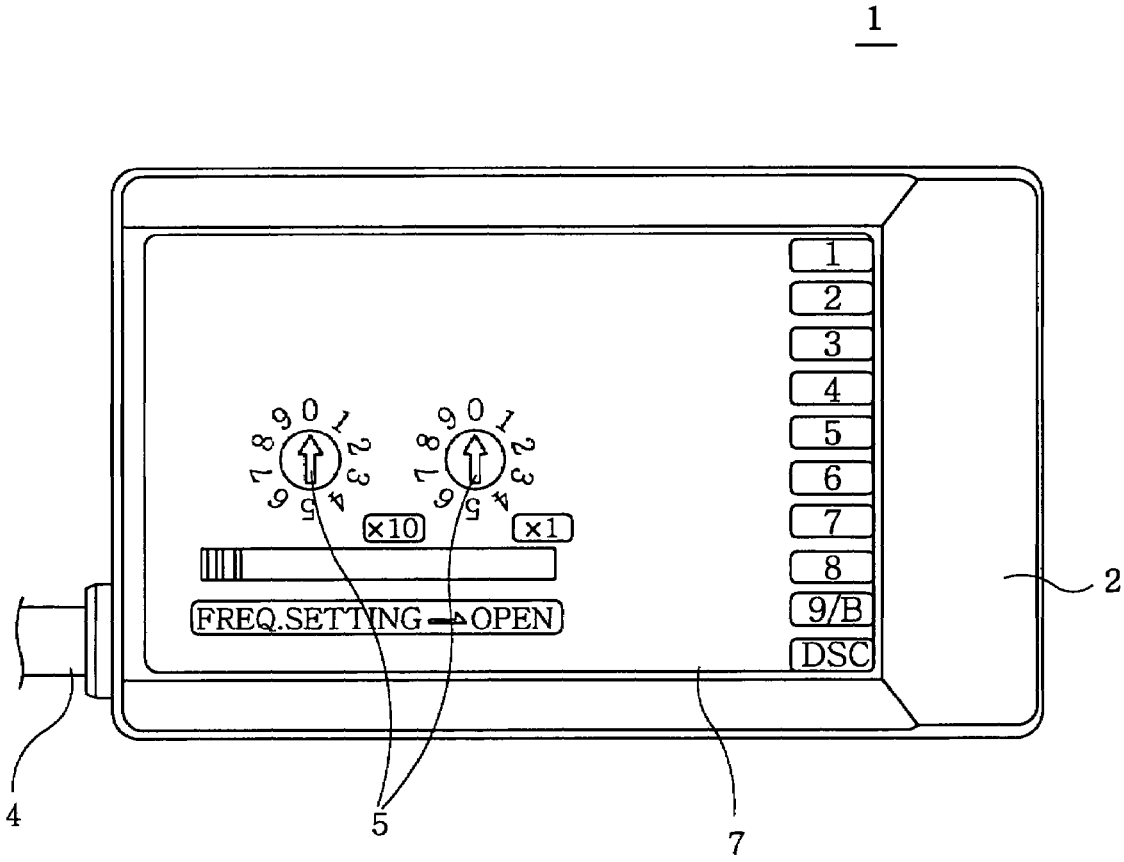
FIG. 1 is a plan view of a receiver of a radio controller in accordance with a preferred embodiment of the present invention.
Figure 2:
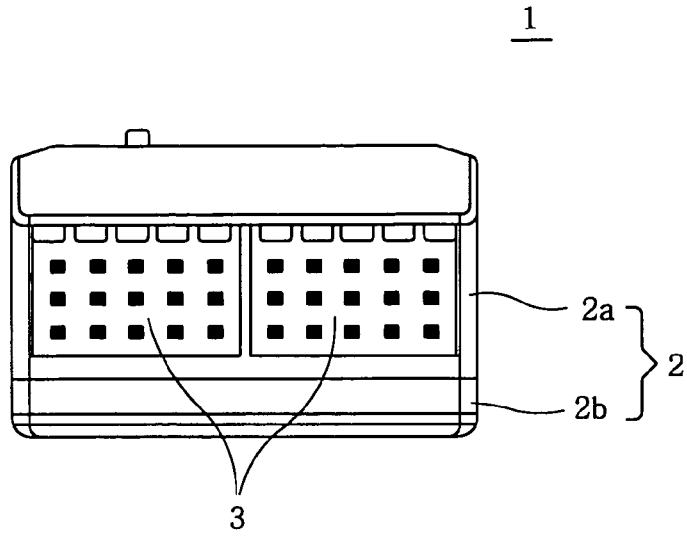
FIG. 2 sets forth a right side view the receive shown in FIG. 1.
Figure 3:
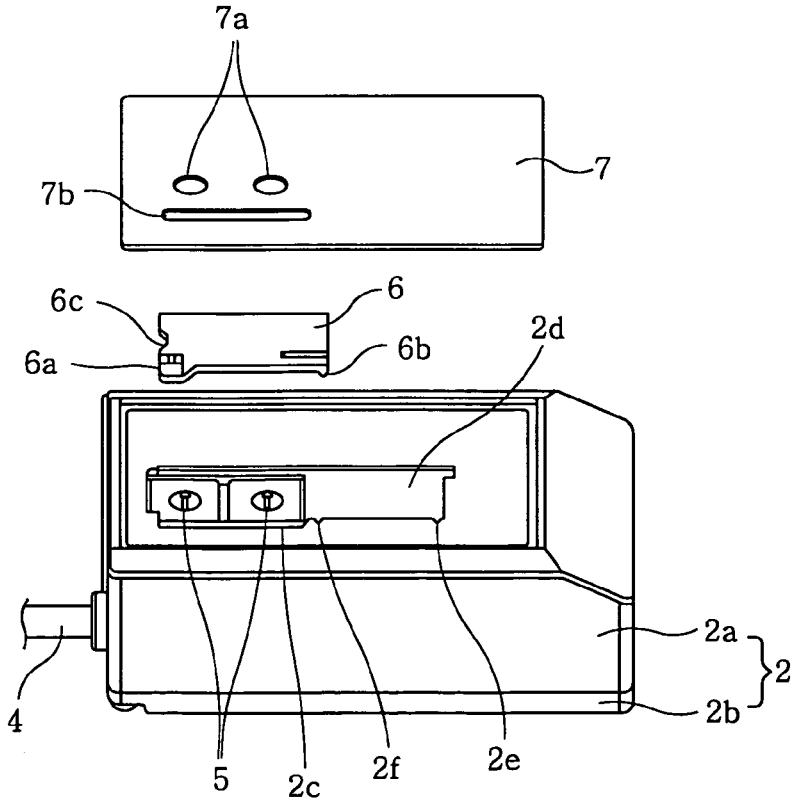
FIG. 3 provides an exploded perspective view illustrating a configuration of a dustproof structure for use in the receiver in accordance with the preferred embodiment of the present invention.

FIG. 1 is a plan view of a receiver 1 of a radio controller (hereinafter, simply referred to as "receiver") and FIG. 2 is a right side view thereof. FIG. 3 sets forth an exploded perspective view of a dustproof structure of the receiver 1 in accordance with a preferred embodiment of the present invention.

Referring to FIGS. 1 to 3, the receiver 1 includes an approximately box-shaped housing 2. The housing 2 has a casing main body 2*a* forming a front surface and side surfaces of the housing 2; and a bottom lid 2*b* forming a bottom surface of the housing 2. The casing main body 2*a* and the bottom lid 2*b* are connected to each other as a single body by an engagement of hooks (not shown) and hook recesses (not shown) at their respective one end portions and screw fixations at their another end portions.

The housing 2 has at its side surface terminals 3 to be connected with a servo system for driving a power supply battery or a driving unit of an object to be controlled. Further, the housing 2 has at an opposite side surface a linear antenna 4 drawn out to be extended from the inside of the housing 2.

Further, as shown in FIG. 3, a circuit board (not shown) forming a receiver circuit is disposed in the housing 2, and a pair of rotary type dual inline package switches (hereinafter referred to as "DIP switches") 5 for switching a receive frequency of the receiver 1 are mounted on the circuit board as internal switches. Also, an opening 2*c* of an approximately rectangular shape is provided in a front surface of the casing main body 2*a* at a position corresponding to the DIP switches 5. Through the opening 2*c*, the DIP switches 5 are exposed to the outside.

The dustproof structure of the receiver 1 in accordance with the present invention includes a shutter plate 6 which is slidable to open or close the opening 2*c*; a cover plate 7 for supporting the shutter plate 6 such that the shutter plate 6 can be freely slid between the casing main body 2*a* and the cover plate 7; and a slide recess 2*d* for forming a sliding area of the shutter plate 6, the slide recess 2*d* communicating with the opening 2*c*.

The shutter plate 6 is formed of a transparent or a translucent plate-shaped member made of, e.g., a resin material. The size of the shutter plate 6 is a bit larger than that of the opening 2*c*, and the shutter plate 6 has a shape capable of covering the entire opening 2*c* with it when the opening 2*c* is closed. Also, a manipulation portion 6*a* for use in sliding the shutter plate 6 is installed at one corner portion of a frontal surface of the shutter plate 6.

The shape of the slide recess 2*d* is designed to receive the shutter plate 6 therein and allow the shutter plate 6 to be linearly slid next to the opening 2*c* of the casing main body 2*a*, to thereby make it possible to open or close the opening 2*c* freely.

That is, in accordance with the preferred embodiment of the present invention, in order to freely slide the shutter plate 6 along a lengthwise direction thereof to open or close the opening 2*c*, the slide recess 2*d* is formed such that the length of a shorter side thereof is substantially identical to that of the shutter plate 6, while the length of a longer side of the slide recess 2*d* is approximately twice the length of the opening 2*c* along a lengthwise direction thereof. Further, the slide recess 2*d* is formed in the surface of the casing main body 2*a* such that its depth is substantially identical to the thickness of the shutter plate 6.

Accordingly, the shutter plate 6 can be accommodated in the slide recess 2*d* such that the surfaces of the casing main body 2*a* and the shutter plate 6 are on a same plane. Further, the sliding movement of the shutter plate 6 is guided by the longer sides of the slide recess 2*d* while its sliding range is confined by the shorter side of the slide recess 2*d*. Thus, the shutter plate 6 can be slid linearly within the slide recess 2*d* while its longer sides are in contact with those of the slide recess 2*d*, to thereby open or close the opening 2*c* freely.

The cover plate 7 is formed of an approximately rectangular plate member made of, e.g., a metal material. The cover plate 7 is provided with communication holes 7*a* communicated with the opening 2*c* at a position corresponding to the DIP switches 5. Also provided at the cover plate 7 is an elongated hole 7*b* through which the manipulation portion 6*a* of the shutter plate 6 is fitted to be linearly moved therein.

Moreover, in the dustproof structure of the receiver 1 in accordance with the preferred embodiment, the cover plate 7 is attached and fixed on the casing main body 2*a* via an adhesive paper or the like while the shutter plate 6 is slidably received in the slide recess 2*d* of the casing main body 2*a*.

In the above-described configuration, by moving the manipulation portion 6*a* of the shutter plate 6 along the elongated hole 7*b* linearly, the shutter plate 6 can be slid along the slide recess 2*d* provided on the casing main body 2*a*, thus making it possible to expose the DIP switches 5 through the communication holes 7*a* via the opening 2*c* or to close the opening 2*c* such that the DIP switches 5 are not exposed through the communication holes 7*a*.

Figure 4:
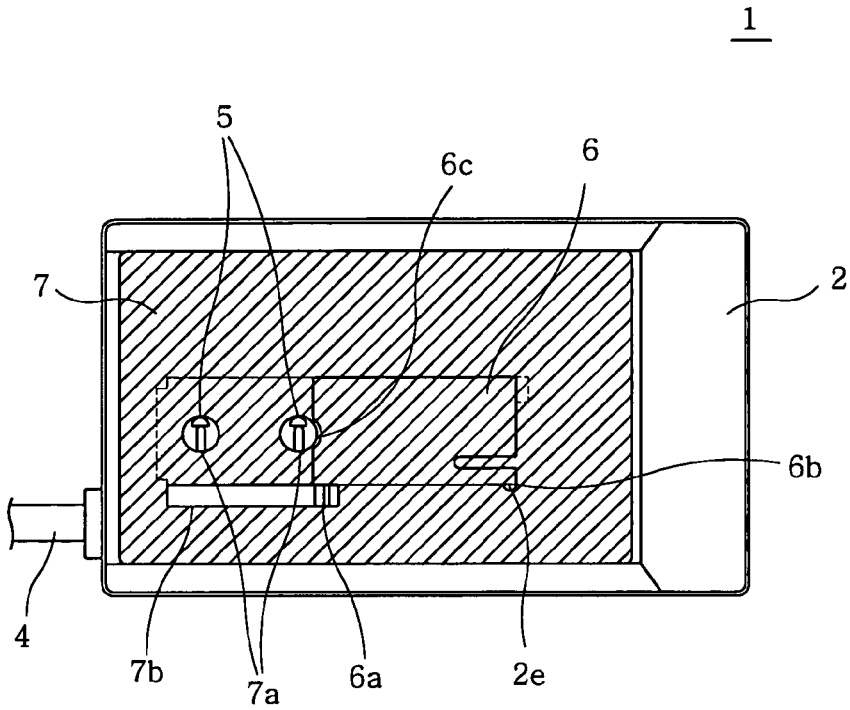
FIG. 4 depicts a plan view of the receiver in accordance with the preferred embodiment of the present invention, in which a shutter plate is opened.
Figure 5:
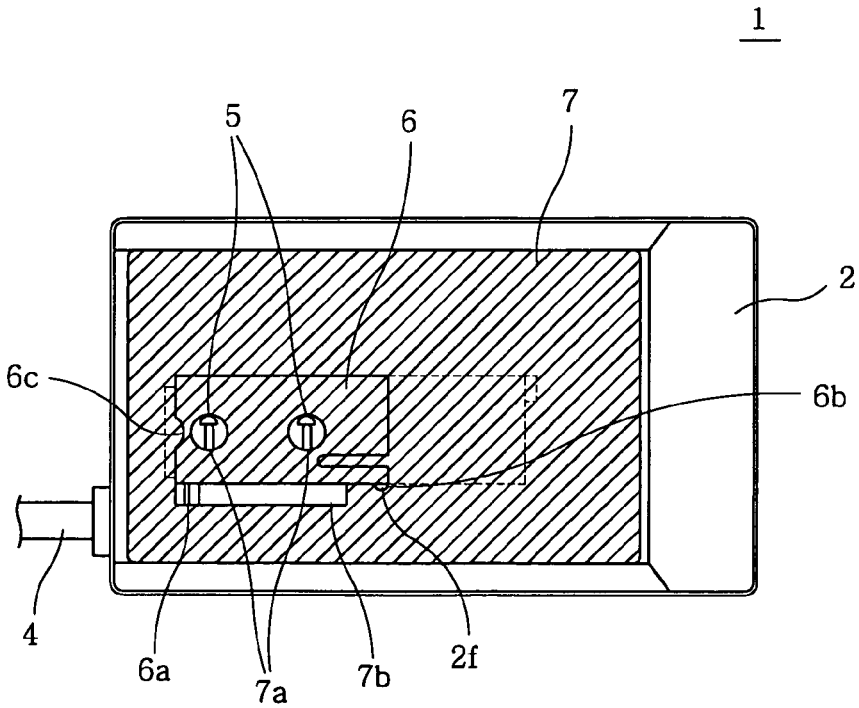
FIG. 5 presents a plan view of the receiver in accordance with the preferred embodiment of the present invention, in which the shutter plate is closed.
Figure 6:
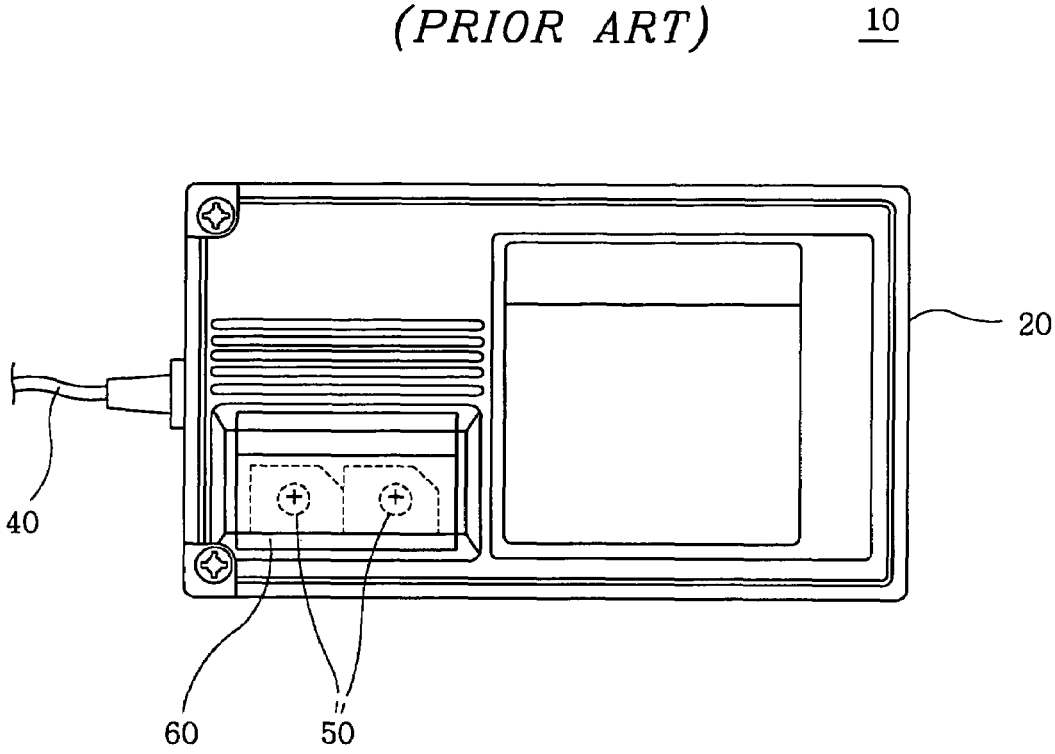
FIG. 6 (PRIOR ART)
FIG. 6 is a plan view of a receiver of a conventional radio controller.
Figure 7:
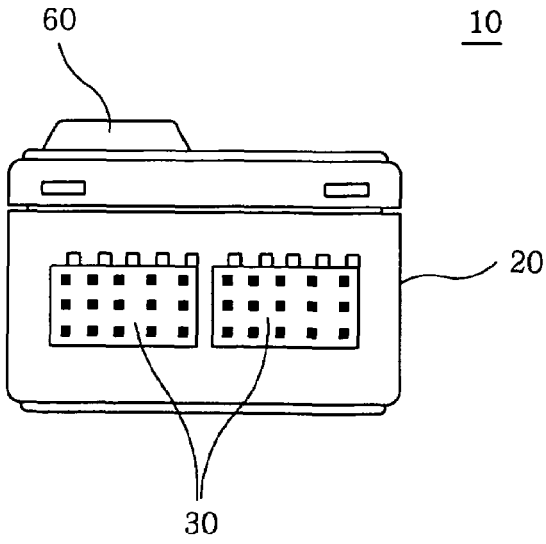
FIG. 7 (PRIOR ART)
FIG. 7 offers a right side view of the receiver shown in FIG. 6.
Figure 8:
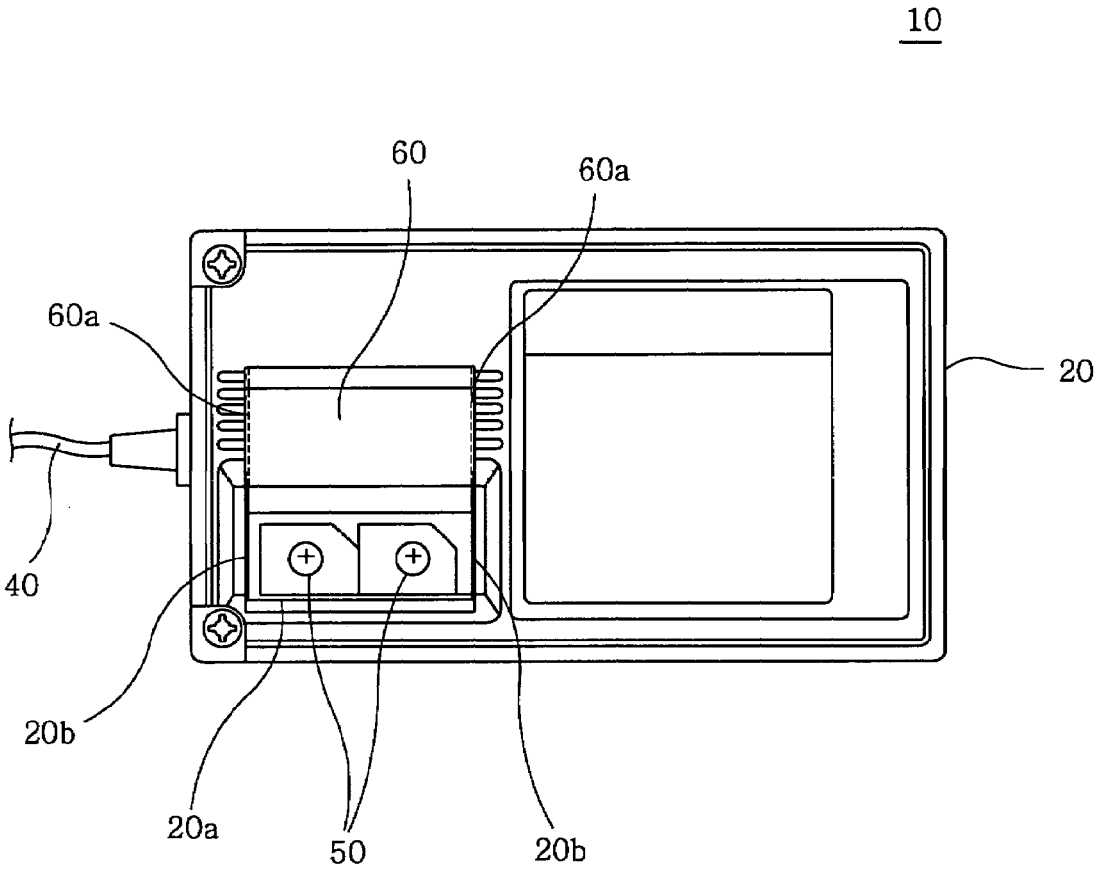
FIG. 8 (PRIOR ART)
FIG. 8 sets forth a plan view of the conventional receiver in which a cover is opened.

FIG. 4 is a plan view of the receiver 1 in which the shutter plate 6 is opened and FIG. 5 provides a plan view of the receiver 1 in which the shutter plate 6 is closed. In these two figures, the cover plate 7 is shown by hatching.

As shown in FIG. 4, when operating the DIP switches 5, the manipulation portion 6*a* is moved toward the terminals 3 to thereby expose the DIP switches 5 through the communication holes 7*a* via the opening 2*c*, thus allowing a user to operate the DIP switches 5.

Meanwhile, when the DIP switches 5 is not used, the manipulation portion 6*a* is moved toward the linear antenna 4 to close and protect the DIP switches 5 by the shutter plate 6, as shown in FIG. 5. Thus, it is possible to prevent dust particles or the like from entering the housing 2 from the outside.

Moreover, since the shutter plate 6 is formed of a transparent or a translucent member, the inside of the shutter plate 6 can be seen through the shutter plate 6 even when the DIP switches 5 are closed by the shutter plate 6. So it is possible to observe the operational states of the DIP switches 5.

In the dustproof structure of the receiver 1 configured as described above in accordance with the preferred embodiment, since the shutter plate 6 for opening or closing the opening 2*c* and the communication holes 7*a* is covered by the cover plate 7, the shutter plate 6 can be effectively strengthened so that it is made highly durable. Therefore, even in case an excessive force is exerted on the shutter plate 6 by touching the shutter plate 6 or the cover plate 7 with a user's finger or an object unintentionally, the shutter plate 6 can be protected from being separated from the casing main body 2*a* or damaged. Also, since the dustproof structure is configured to have a flat shape, size reduction of the receiver can be realized.

Further, a protrusion 6*b* is formed at another corner portion of the shutter plate 6, and a slit is formed at the shutter plate 6 so that it is inwardly extended from the shorter side of the shutter plate 6 at which the protrusion 6*b* is formed. Also, the slide recess 2*d* has a first notch 2*e* and a second notch 2*f*. The protrusion 6*b* of the shutter plate 6 is fitted into the first notch 2*e* to be locked therein when the shutter plate 6 is opened, whereas it is fitted into the second notch 2*f* to be locked therein when the shutter plate 6 is closed.

Thus, when the shutter plate 6 is opened (as shown in FIG. 4), the protrusion 6*b* of the shutter plate 6 is locked in the first notch 2*e* of the slide recess 2*d*. When the shutter plate 6 is closed (as illustrated in FIG. 5), on the other hand, the protrusion 6*b* of the shutter plate 6 is locked in the second notch 2*f* of the slide recess 2*d*. Therefore, once the shutter plate 6 is opened or closed, it will not be easily slid due to an unintentional touch or vibration.

In addition, when the shutter plate 6 is slid from the first notch 2*e* to the second notch 2*f*, the protrusion 6*b* of the shutter plate 6 is made to slide while it presses a side surface of the slid recess 2*d*.

As a result, when sliding the shutter plate 6 by using the manipulation portion 6*a*, it is possible to slide the shutter plate 6 without being vibrated while maintaining an appropriate friction so that manipulation thereof can be facilitated.

Furthermore, an approximately semicircular cutoff portion 6*c* is formed at one of the shorter sides of the shutter plate 6, whereby the sliding distance of the shutter plate 6 can be reduced when sliding the shutter plate 6 to open or close the communication holes 7*a*.

Further, a serial number of the receiver 1 is written on the front surface of the cover plate 7, and characters or numbers to be used as operational indicators of the DIP switches 5 are also written on the front surface of the cover plate 7 at positions corresponding to the communication holes 7*a*. The numbers and the characters are used to assist the manipulation of the DIP switches 5.

Though the dustproof structure for use in an electronic equipment in accordance with the preferred embodiment of the present invention has been described, the present invention is not limited thereto. Each component can be replaced by another element that has a same function. Further, it is also possible to add some elements to the above-described configuration of the present invention.

For example, though the slide recess which forms the sliding area of the shutter plate is formed in the housing in the above-described preferred embodiment, it is also possible to form the slide recess in the cover plate, wherein the shutter plate is interposed between the cover plate and the housing, or in both of the housing and the cover plate.

Moreover, in the above-described preferred embodiment, though the slide recess serving as the sliding area of the shutter plate is formed in the housing of the receiver along the longitudinal direction thereof, the present invention is not limited thereto. For example, the slide recess may be formed along a direction parallel to the shorter sides of the shutter plate, realizing the same effects.

Further, the dustproof structure for use in an electronic equipment in accordance with the present invention can be applied to various personal or industrial electronic equipments in addition to the radio controller exemplified in the preferred embodiment of the present invention.

While the invention has been shown and described with respect to the preferred embodiments, it will be understood by those skilled in the art that various changes and modifications may be made without departing from the scope of the invention as defined in the following claims.

What is claimed is:

1. A dustproof structure for an electronic equipment which includes internal switches disposed in a housing forming an external frame of the electronic equipment and an opening for use in operating the internal switches, the dustproof structure comprising:

a cover plate provided with communication holes; and a shutter plate movable between an open position and a closed position, the shutter plate being provided slidably between the cover plate and the housing, wherein when the shutter plate is at the open position, the internal switches are exposed to an outside of the electronic equipment through the communication holes and the opening, thus allowing a user to directly operate the internal switches, and wherein a slide recess serving as a sliding area of the shutter plate is formed in the housing or the cover plate.

2. The dustproof structure of claim 1, wherein the shutter plate has a manipulation portion for use in sliding the shutter plate; and the cover plate is provided with an elongated hole through which the manipulation portion of the shutter plate is fitted to be linearly moved therein.

3. The dustproof structure of claim 1, wherein the internal switches are rotary dual inline package switches.

4. The dustproof structure of claim 1, wherein the slide recess includes first and second notches, and a protrusion is formed at a corner portion of the shutter plate, and wherein the protrusion of the shutter plate is fitted into the first notch when the shutter plate is at the open position, whereas the protrusion is fitted into the second notch when the shutter plate is at the closed position.

* * * * *